United States Patent [19]

Woodard

[11] 4,152,097

[45] May 1, 1979

[54] DEEP WELL PUMP ADAPTER WITH INFLATABLE SEAL MEANS

[76] Inventor: Karl Woodard, 340 Fenton Ave., Utah 84115

[21] Appl. No.: 758,700

[22] Filed: Jan. 12, 1977

[51] Int. Cl.[2] ..... F04B 17/00

[52] U.S. Cl. ..... 417/360

[58] Field of Search ..... 417/360, 424

[56] References Cited

U.S. PATENT DOCUMENTS

| | | | |
|---|---|---|---|
| 1,374,116 | 4/1921 | Schorr | 417/360 |
| 1,428,238 | 9/1922 | Keating | 417/360 |
| 2,843,052 | 7/1958 | Andrus | 417/363 X |
| 3,907,463 | 9/1975 | Ellen et al. | 417/360 |
| 4,080,106 | 3/1978 | Haesloop | 417/360 |

*Primary Examiner*—Carlton R. Croyle
*Assistant Examiner*—R. E. Gluck

[57] ABSTRACT

A deep well pump adapter with seal means comprising a cylindrical adapter suspended by cable means and carrying an impeller pump thereon with spaced inflatable ring members and hydraulic line means in communication with the inflatable ring members to inflate said rings so that they can contact the cylindrical casing of the well.

1 Claim, 4 Drawing Figures

Fig. 2
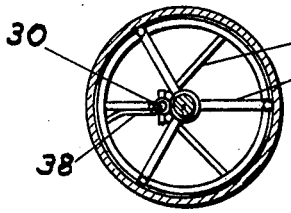
Fig. 3
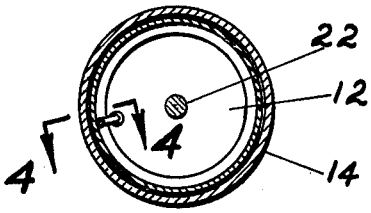
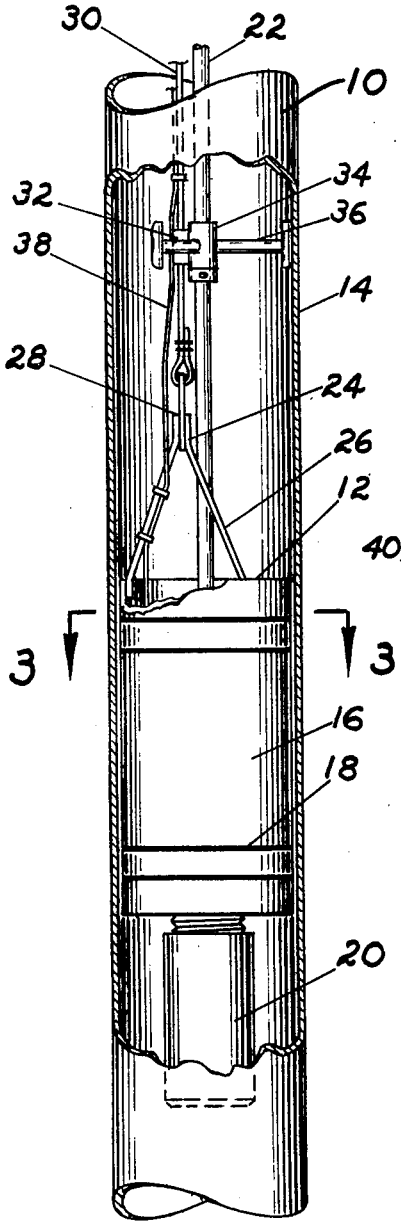
Fig. 1
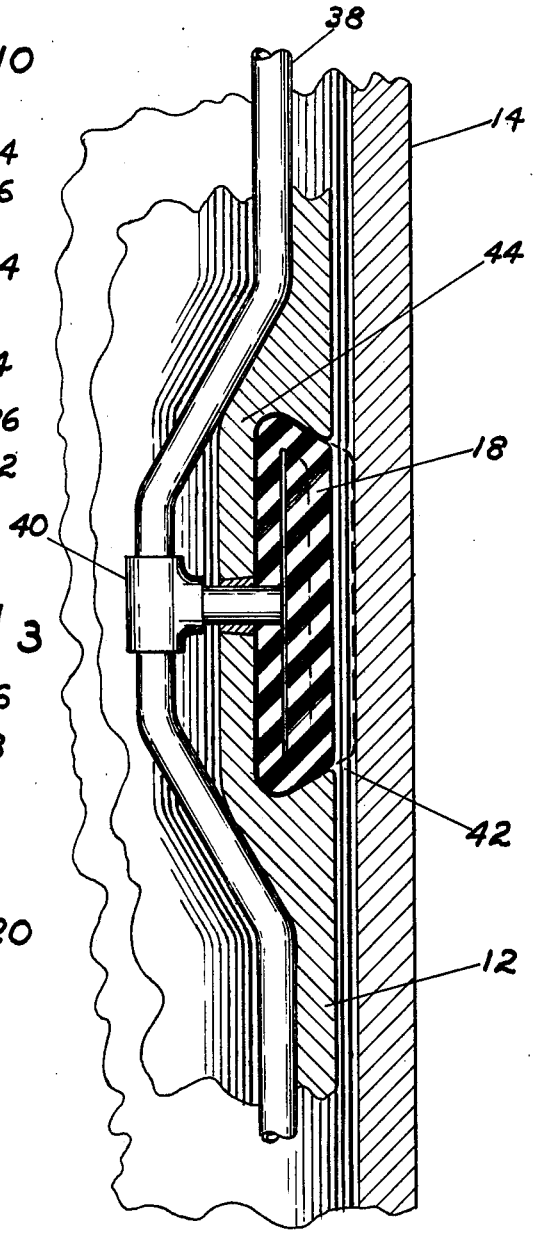
Fig. 4
INVENTOR: KARL WOODARD
BY

DEEP WELL PUMP ADAPTER WITH INFLATABLE SEAL MEANS

The present invention relates to a deep well pump and more particularly to ones in which a pump is lowered down the casing well to pump the water to the ground surface.

It is an object of the present invention to provide an adapter for placing a pump in the well with adapter means that can be inflated and controlled from above the ground so as to properly dispose the pump at the desired depth in the well.

It is another object of the present invention to provide an adapter with inflatable ring means for positioning a pump at a desired location in the well which eliminates an inner casing in wells used heretofore.

It is still another object of the present invention to provide an adapter for a deep well which can position the pump at a desired location in the well by simple inflatable means which can be readily deflated and the pump can be pulled up from the well without disconnecting each length of an inner casing disposed in wells used heretofore and thus eliminate the expense of heavy equipment and reduce the time required to replace the pump.

It is yet another object of the present invention to provide an adapter upon which is disposed a pump for pumping water from a deep well and which requires only drawing up the adapter assembly by reeling up a suspension cable when it is desired to withdraw the pump from the well.

Another object of the present invention is to provide an adapter having inflatable ring means to locate the pump in the desired position and in which the entire area of the casing is utilized to flow water upwardly to the ground surface.

Another object of the present invention is to provide an adapter for a deep well with inflatable ring sealing means to stablize the pump assembly and to prevent vibration and to seal the allowance space in the casing to prevent return flow around the chamber where the adapter is located.

Various other objects and advantages of the present invention will readily apparent when considered with the accompanying drawings forming a part thereof and in which:

FIG. 1 is a side elevational view illustrating the deep well with the adapter of the present invention embodied therein;

FIG. 2 is a plan view of the upper end of FIG. 1;

FIG. 3 is a section taken along the line 3—3 of FIG. 1, and

FIG. 4 is an enlarged detailed view of the adapter assembly illustrating the inflatable sealing means utilized therein.

Referring to the drawings, the reference numeral 10 generally designates a deep well in which water is disposed and the reference numeral 12 designates the pump adapter. The deep well 10 is provided with a metal casing 14. The adapter 12 comprises a substantially cylindrical central portion 16 with inflatable plastic rings 18 spaced adjacent the top and the bottom thereof. The inflatable rings 18 in FIG. 4 are shown in an deflated position so that they are not in contact with the metal casing wall 14. An impeller pump 20 is threadably secure to the lower end of the adapter 12 and is operatively connected to a central shaft 22 which is disposed at the top of the well on the ground and which drives the pump 20. Secured to the top of the adapter by any suitable means is a suspension yoke 24. It may be preferably attached to the adapter by welding or by any other suitable means and consist of a series of triangular braces 26 which converge at 28 and are connected to a vertical suspension cable 30 which extends outwardly at the top of the well and due to the weight of the adapter and the pump is maintained in a taut position. The suspension cable 30 is also provided with a cable guide 32 which may be preferably connected to the shaft bearing 34 by any suitable means, as best seen in FIG. 1 so that the suspension cable does not interefere with the rotation of the drive shaft 22. Also, shaft braces 36 may be disposed above the adapter 12 so as to provide and stabilize the shaft. Referring to the enlarged detailed view of FIG. 4, it wil l be noted that there is provided a hydraulic line 38 which extends downwardly into the adapter 12. This hydraulic line 38 can also be seen in FIG. 1.

The purpose of the deep well pump adapter is to maintain the pump in the well at a desired vertical level or depth.

The rings 18 are preferably made of plastic and communicate with hydraulic line 38 by a T-shaped connection 40 which has its discharge inserted into the inflatable O-ring 18. The rings are somewhat elongated as best seen in FIG. 4.

In operation, once the pump 20 is lowered into the well casing 14 and it is desired to maintain the pump at a predetermined depth therein, hydraulic fluid is supplied through the hydraulic line 38 and T connection 40 and is pumped into the inflatable O-rings 18. This, of course, will inflate them and the rings will then extend outwardly beyond the adapter 12 and come in contact with the inner wall of the casing 14 as best illustrated in dotted lines in FIG. 4. Thus, the pump will be readily maintained at this level until it is desired to move it to a new level.

Should it be necessary to replace the pump 20, it is only necessary to pump out the fluid in line 38 so that the O-rings again will be deflated and assume the position shown in FIG. 1 in which they are out of contact with the metal casing.

The expansion of these O-rings 18 stabilizes the assembly, and prevents vibration, and also seals the allowance space 42 to prevent return flow around the central chamber 44 of the adapter.

Thus, from the foregoing description, it is apparent that the present invention provides a deep well pump adapter with inflatable seal means so as to eliminate the necessity for an inner casing and to give a larger diameter for water flow and which can be readily positioned at any desired depth. Another advantage of the present invention is that the size of the pump is not necessarily related to an inner casing size. With conventional equipment, the pump is screwed into a sleeve at the bottom of the inner casing while with this invention, the flow of a well can be increased because of the use of the larger casing.

Inasmuch as various changes may be made in the location of the several parts embodied in the present invention, it is not meant to limit the scope of the invention except by the scope of the appended claims.

What is claimed is:

1. A deep well pump adapter with seal means comprising a cylindrical elongated member suspended by flexible cable means and carrying an impeller pump thereon being driven by a central shaft and having with spaced inflatable ring members and hydraulic line means adjacent said flexible cable means and in communication with the inflatable ring members to inflate said ring members so they contact a cylindrical casing of a well in which it is disposed, said hydraulic line means being a pipe with a T-connection in communication with each of said ring members, said cable means having a triangular yoke above said adapter to center said adapter, brace means are provided above said adapter to center said adapter, said brace means having a bearing supporting said shaft, said adapter having annular recesses in its outer wall and said recesses having said ring members being embedded in said recesses and being of a dimension that their outer walls are flush with the outer wall of said adapter when deflated, said ring members being elongated in a vertical direction and being substantially horizontally disposed and being disposed in spaced relationship adjacent the top and bottom of said adapter.

* * * * *